US006537487B1

(12) United States Patent
Kuhns

(10) Patent No.: US 6,537,487 B1
(45) Date of Patent: Mar. 25, 2003

(54) METHOD OF MANUFACTURING FORM TOOLS FOR FORMING THREADED FASTENERS

(76) Inventor: Michael L. Kuhns, c/o Manufacturing Management Group, LLC, 200 N. Wheeling Rd., Prospect Heights, IL (US) 60008-1095

( * ) Notice: Subject to any disclaimer, the term of this patent is extended or adjusted under 35 U.S.C. 154(b) by 0 days.

(21) Appl. No.: 09/588,935

(22) Filed: Jun. 5, 2000

(51) Int. Cl.[7] ..... B22F 3/12
(52) U.S. Cl. ..... 419/29; 419/36; 419/37
(58) Field of Search ..... 419/36, 37, 29

(56) References Cited

U.S. PATENT DOCUMENTS 3,882,210 A 5/1975 Crossley et al.
5,077,002 A 12/1991 Fried
5,252,119 A * 10/1993 Nishida et al. ..... 75/236
5,314,658 A 5/1994 Meendering et al.
5,397,531 A 3/1995 Peiris et al.
5,482,671 A 1/1996 Weber
5,666,633 A 9/1997 Arnold et al.
5,737,683 A 4/1998 Sterzel
5,754,937 A 5/1998 Jones et al.
5,972,269 A 10/1999 Barros et al.
5,985,208 A 11/1999 Zedalis et al.
6,224,816 B1 * 5/2001 Hull et al. ..... 264/401

* cited by examiner

*Primary Examiner*—Daniel J. Jenkins
(74) *Attorney, Agent, or Firm*—Wood, Phillips, Katz, Clark & Mortimer

(57) ABSTRACT

A method is provided for manufacturing a form tool used for forming threaded fasteners. The method utilizes powdered metal technology and processes to produce densified parts having at least the near net shape of the desired threaded fastener form tool.

12 Claims, 3 Drawing Sheets

METHOD OF MANUFACTURING FORM TOOLS FOR FORMING THREADED FASTENERS

FIELD OF THE INVENTION

This invention relates to form tools for forming threaded fasteners, and more particularly, to a method of manufacturing threaded fastener form tools.

BACKGROUND OF THE INVENTION

Form tools for forming threaded fasteners (hereinafter referred to as "threaded fastener form tools") are well-known in the threaded fastener industry. A few examples of the many known types of threaded fastener form tools are shown in FIGS. 1A–5. Specifically, FIGS. 1A–2B illustrate two punch-type threaded fastener form tools used for impact forming threaded fastener heads. More specifically, FIGS. 1A and 1B illustrate a threaded fastener form tool 10 for forming a flat head with a TORX type drive on a threaded fastener, while FIGS. 2A and 2B illustrate a threaded fastener form tool 12 used for forming a flat head with a PHILLIPS type drive on a threaded fastener. FIGS. 3A and 3B illustrate another form of punch-type threaded fastener form tool 13 used to finish the head and a TORX-type drive on a threaded fastener. While only three examples are illustrated, it will be appreciated that similar punch-type form tools can be used to form other types of threaded fastener heads, such as for example, round heads, fillister heads, oval heads, hexagon heads, and socket heads, as well as other types of drives, such as for example, hex socket, drilled spanner, fluted socket, slotted spanner, slotted, clutch, pozi drive, and one-way. FIGS. 4A and 4B illustrate a so-called "tri-lobular" form tool 14 and FIG. 5 illustrates a rolling thread type flat form tool 16 for forming the threads on a threaded fastener. While only two examples are illustrated, it will be appreciated that there are a number of other types of form tools used for forming the threads and shank of a threaded fastener.

Typically, threaded fastener form tools must produce a large number of threaded fasteners at a relatively high production rate to provide an economically feasible product. Additionally, the threaded fasteners are often formed from high strength materials and the features of the threaded fasteners must be held to relatively tight tolerances to provide the desired capabilities and quality for the threaded fasteners. Further, many of the threaded fasteners have relatively intricate, small scale features that must be mirrored on the threaded fastener form tools as shown by the examples in FIGS. 1A–2B. In view of these factors, threaded fastener form tools are typically made from materials having very high strength and hardness and must be manufactured with great precision in order to produce threaded fasteners having the desired features, capabilities and quality. Conventionally, such threaded fastener form tools are manufactured by highly skilled machinists using precision machining operations or from wrought metal material. While this method of manufacture produces acceptable threaded fastener form tools, it is relatively expensive and time-consuming.

SUMMARY OF THE INVENTION

It is a primary object the invention to provide a new and improved method of manufacturing threaded fastener form tools.

According to one embodiment of the invention, the method includes the steps of preparing a feedstock of powdered metal and binder; heating and injecting the feedstock into a mold having an over-sized, negative image of the threaded fastener form tool; hardening the feedstock in the mold to form a green part; removing the green part from the mold; debinding the green part to form a debound part; and sintering the debound part to form a densified part having at least the near net shape of the threaded fastener form tool.

According to another embodiment of the invention, the method includes the steps of loading a powdered metal mixture into a compression mold having a negative image of the threaded fastener form tool; compressing the powdered metal mixture in the compression mold to form a green part having at least the near net shape of the threaded fastener form tool; removing the green part from the compression mold; and sintering the green part to form a densified part having at least the near net shape of the threaded fastener form tool.

In accordance, with one form of the invention, the method further includes the steps of heat treating and/or finish machining the threaded fastener form tool after the sintering step.

Other objects and advantages will become apparent from the following specification taken in connection with the accompanying drawings.

DETAILED DESCRIPTION OF THE PREFERRED EMBODIMENTS

While a few examples of the many known types of threaded fastener form tools have been described in the Background section and shown in FIGS. 1A–5, it should be appreciated that the preferred embodiments of the method for manufacturing a threaded fastener form tool described herein may be utilized for manufacturing any threaded fastener form tool. Accordingly, it should be understood that no limitation to use with a specific type of threaded fastener form tool is intended except in so far as expressly stated in the appended claims.

Figure 1A:
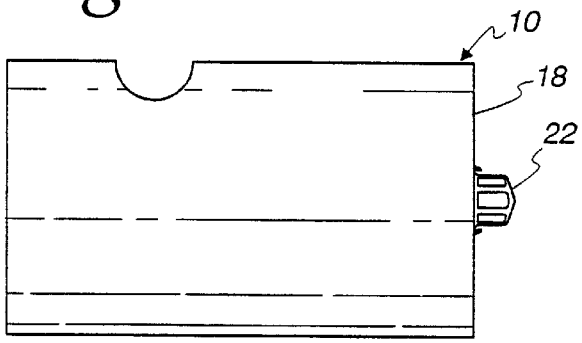
FIGS. 1A and 1B are a side and end view, respectively, showing one example of a threaded fastener form tool used for forming a threaded fastener.
Figure 1B:
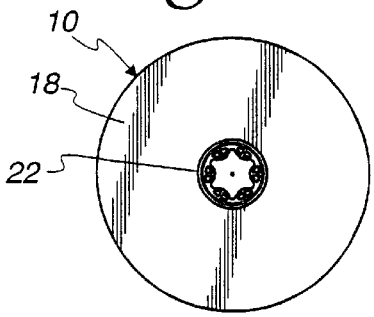
Figure 2A:
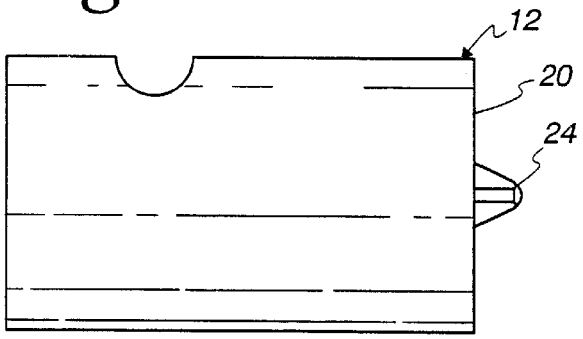
FIGS. 2A and 2B are a side view and an end view, respectively, of another example of a threaded fastener form tool.
Figure 2B:
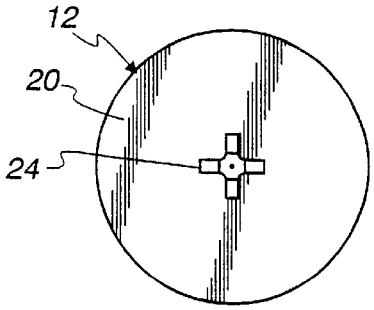
Figure 3A:
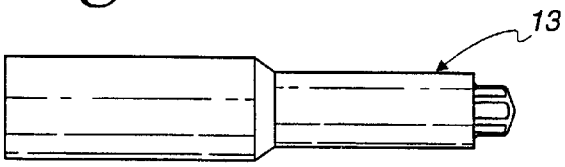
FIGS. 3A and 3B are a side view and an end view, respectively, of a further example of a threaded fastener form tool.
Figure 3B:
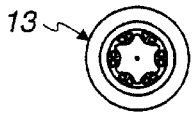
Figure 4A:
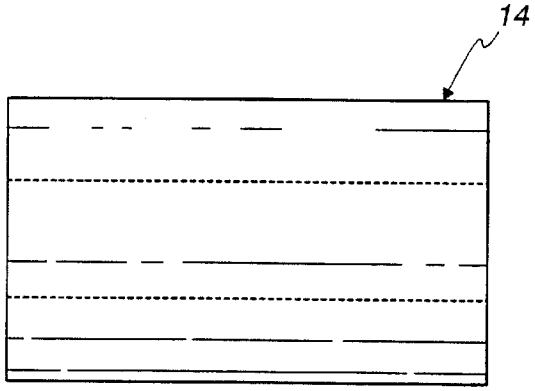
FIGS. 4A and 4B are a side view and an end view, respectively, of yet another example of a threaded fastener form tool.
Figure 4B:
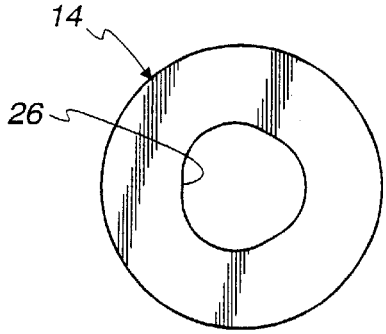
Figure 5:
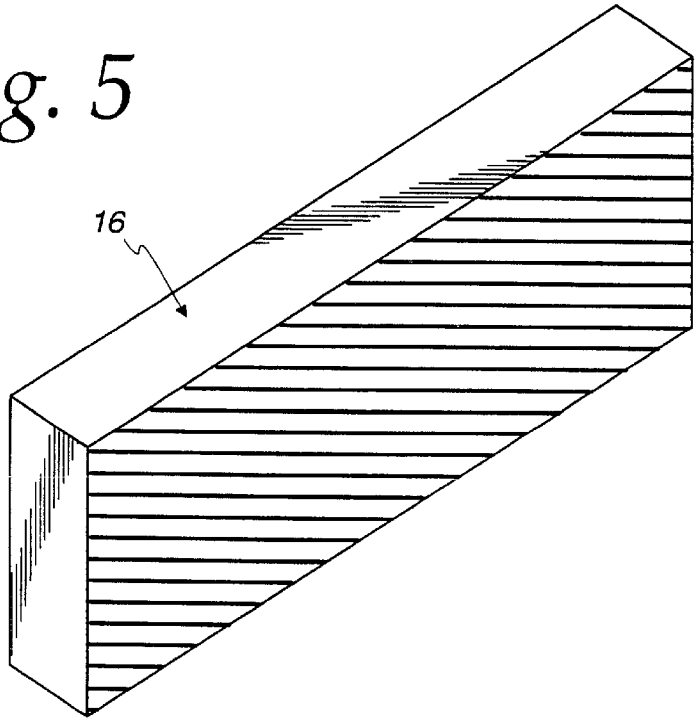
FIG. 5 is a perspective view showing yet another example of a threaded fastener form tool.
Figure 6:
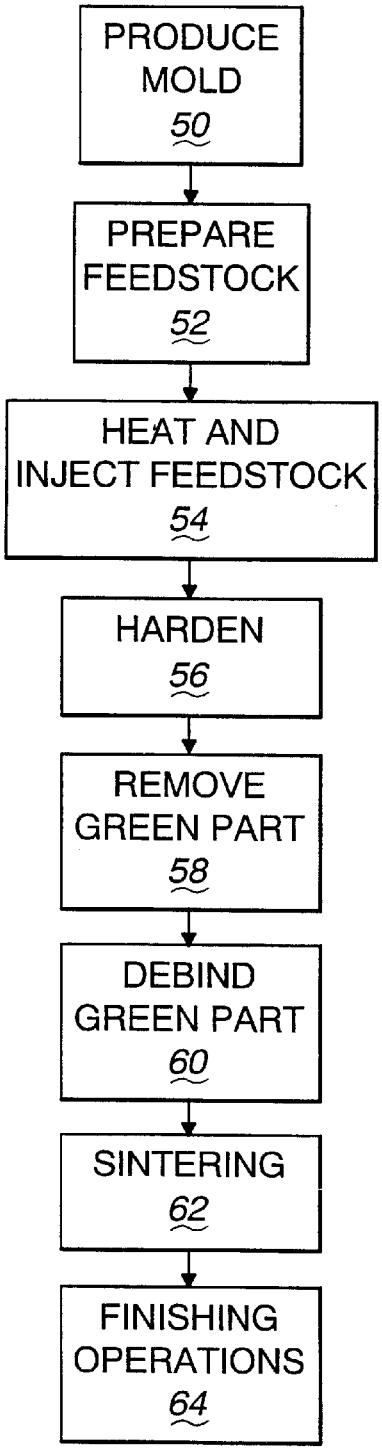
FIG. 6 is a flow diagram illustrating a method of manufacturing a threaded fastener form tool embodying the present invention.

FIG. 6 depicts a method for manufacturing a threaded fastener form tool. The method utilizes metal injection molding (MIM) processes to manufacture the form tool. As shown at block 50, a mold is produced having an over-sized, negative image of a desired threaded fastener form tool, such as an over-sized negative image of any of the threaded fastener form tools described in the Background Section and/or shown in FIGS. 1A–5. As will be explained in more detail below, the negative image will typically be over-sized in the range of about 15% to about 22% greater than the net shape of the desired threaded fastener form tool to allow for shrinkage of the "green part" produced using the mold. The exact amount of over-sizing will be highly dependent upon the configuration of the desired threaded fastener form tool and the materials selected therefor. The mold is similar to the molds used in plastic injection molding and can include features, such as gates to ensure that the mold is completely filled. As is common in plastic injection molding, it is preferred that the mold be a modular type mold having a number of modular inserts that may be selectively used in the mold to produce different configurations of threaded fastener form tools. For example, a modular type die can be provided to form a variety of the punch-type threaded fastener form tools 10 and 12 shown in FIGS. 1A–B and 2A–B by providing a modular insert that would define the outside diameter or shape of the threaded fastener from tool and another modular insert that would define the respective end portions 18 and 20 and drive-forming features 22 and 24 of the threaded fastener form tools 10 and 12. By way of further example, a modular type mold could be provided for forming a variety of tri-lobular die tools 14, with a modular insert used to define the outside diameter of the die tool 14 and a modular core used to define the interior features 26 of the die tools 14.

As shown at block 52, a feedstock is prepared by blending powdered metal with a binder, which is typically a polymer. Other components, such as a dispersant, may also be blended into the feedstock. Typically, the powdered metal will be extremely fine (in the range of about 10 to about 20 microns). However, it is known to use particle sizes of less than 10 microns. Many suitable types of powdered metals, binders, and other additives are commercially available for use in preparing the feedstock. The preparation of this feedstock often includes plasticizing the components of the feedstock after they are blended and then granulating the plasticized feedstock after it is solidified. While it is possible to form a number of suitable materials using MIM processes, it is preferred that the threaded fastener form tools be made of tool steel or carbide, such as M-4 tool steel or D-70 carbide. The specific parameters for preparing feedstock, such as the components and their relative proportions, will be highly dependent upon the particular configuration of the desired threaded fastener form tool and the specific material and material properties desired for the threaded fastener form tool, and are within the abilities of one skilled in the art to select.

As shown at block 54, after it is prepared, the feedstock is injected into the mold using a suitable injection molding tool, a number of forms of which are well-known. During the injection process, the feedstock is heated to a flowable state that allows the feedstock to fill the negative image in the mold. As shown at blocks 56 and 58, after it is injected into the mold, the feedstock material hardens to a solid or gel-like state to form a "green part" that can be removed from the mold, with the part being substantially or completely self-supporting.

Next, as shown at block 60, the green part undergoes a debind operation wherein most or all of the binder is removed from the green part using heat and/or solvent depending upon the type of binder used. Because of the removal of binder, the debound parts are relatively porous, but will typically be approximately the same size as the green part. If heating is used, it will typically be done using a controlled atmosphere furnace. The specific parameters used during the debind operation, such as atmosphere, pressure, type of solvents, temperatures, and time at temperatures, will be highly dependent upon the particular application, and are within the abilities of one skilled in the art to select. For example, the temperature of the heating and/or the composition of the solvent will be dependent upon the materials used in the feedstock and, in particular, the type of binder used in the feedstock.

The debind operation produces a so-called "brown" or "debound" part which can then be sintered at an elevated temperature typically above 2,200° Fahrenheit but below the melting point of the material in the debound part, as shown at block 62. The sintering operation will typically take place in a controlled atmosphere furnace, and will typically remove any binder that remains in the debound part. Depending upon the particular material selection for the threaded fastener form tool and the desired final properties of the material, isostatic pressing may be employed during the sintering process, as is known. During the sintering operation, the surface energy between the metal particles in the debound part is released and the metal particles are fused together thereby densifying and shrinking the debound part into a densified part, which is either the near net shape or the net shape of the desired threaded fastener form tool. As discussed above in connection with the over-sized image in the mold, the shrinkage of the debound part to the densified part can be in the range of about 15% to about 22%. The specific parameters of the sintering operation, such as the temperatures, time at temperatures, atmosphere, and pressure, will be highly dependent upon the configuration of the threaded fastener form tool being manufactured, and the material and the final material properties desired for the threaded fastener form tool, and are within the capabilities of one skilled in the art to select.

Optionally, if required after the sintering operation, a number of finishing operations may be performed on the densified part, as shown at block 64. For example, after the sintering operation, the densified part may undergo heat treating, such as quench and temper, austempering, induction hardening, or case hardening, to provide a desired tensile strength and hardness for the threaded fastener form tool. Again, the particular type of hardening and the parameters thereof will be highly dependent upon the configuration of the desired threaded fastener form tool and the desired material and material properties of the threaded fastener form tool, and are within the capabilities of one skilled in the art to select. By way of further example, as required after a sintering operation, or after the hardening operation if one is employed, the densified part may be finish machined to achieve the dimensional tolerances desired for the threaded fastener form tool.

Figure 7:
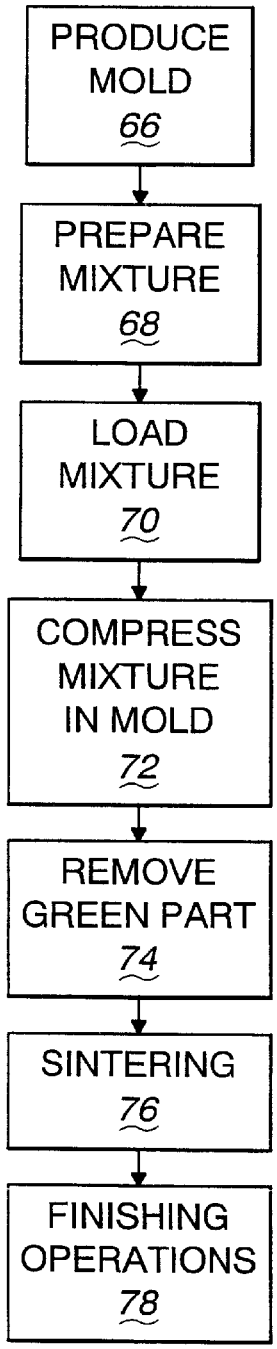
FIG. 7 is another flow diagram illustrating another method of manufacturing a threaded fastener form tool embodying the present invention.

As seen in FIG. 7, a method utilizing powdered metal compression and sintering is provided for manufacturing a threaded fastener form tool. As seen at block 66, a compression mold is formed having a negative image of the desired threaded fastener form tool, with the negative image being the near net shape or the net shape of the finished form tool when the compression mold is in a compressing position. As seen at block 68, various powdered components are combined to form a metal powder mixture that will produce the desired material and material properties for the threaded fastener form tool. In addition to alloying components, the mixture may include other ingredients, such as die lubricants. While it is possible to form a number of suitable materials using powdered metal processes, it is preferred that the threaded fastener form tools be made of tool steel or carbide, such as M-4 tool steel or D-70 carbide. The components and their relative proportions will be highly dependent upon the particular threaded fastener form tool being manufactured and on the material and material properties desired for the threaded fastener form tool, and are within the abilities of one skilled in the art to select. As shown at blocks 70 and 72, a volume of this mixture of about 2 to about 3 times the volume of the desired threaded fastener form tool is loaded into the compression mold and then compressed in a mold press, many forms of which are known. The compression forms the mixture into a green part that is self-supporting and can be removed from the compression mold, as shown at block 74. Preferably the green part has the near net shape or the net shape of the desired threaded fastener form tool. The green part is then sintered in a controlled atmosphere furnace to fuse or metallurgically bond the metal particles together without melting to form a densified part, as shown in block 76. Typically, the sintering temperatures will be over 2000° Fahrenheit but below the melting point of the materials in the mixture. Again, the selection of the specific parameters of the sintering operation are within the abilities of one skilled in the art and will be highly dependent upon configuration of the desired threaded fastener form tool, the particular powdered metal materials used and the final material properties required for the threaded fastener form tool. As with the previously described embodiment, after the sintering operation, the densified part may undergo selected finishing operations, such as hardening and/or finish machining, as required to achieve the desired tolerances, tensile strength, and hardness for the threaded fastener form tool, as shown at block 78.

Because the densified parts are the near net shape or the net shape of the desired threaded fastener form tool, the above described methods can significantly reduce the amount of expensive machining and time required to produce threaded fastener form tools having the desired tolerances, features, and material properties. Thus, the above-described methods may produce threaded fastener form tools in a more timely fashion and at less expense than can be provided using conventional methods of manufacture. Further, the consistency of the threaded fastener form tools produced using the same mold may be improved over the consistency of threaded fastener form tools manufactured using conventional machining techniques.

What is claimed is:

1. A method of manufacturing a threaded fastener form tool, the method comprising the steps of:

preparing a feedstock of powdered metal and binder;

heating and injecting the feedstock into a mold having an over-sized, negative image of the threaded fastener form tool;

hardening the feedstock in the mold to form a green part;

removing the green part from the mold;

debinding the green part to form a debound part; and sintering the debound part to form a densified part having at least the near net shape of the threaded fastener form tool.

2. The method of claim 1 further comprising the step of heat treating the densified part.

3. The method of claim 2 wherein the heat treating step comprises austempering the densified part.

4. The method of claim 2 wherein the heat treating step comprises induction hardening the densified part.

5. The method of claim 2 wherein the heat treating step comprises case hardening the densified part.

6. The method of claim 2 further comprising the step of finish machining the densified part after the heat treating step.

7. A method of manufacturing a threaded fastener form tool, the method comprising the steps of:

loading a powdered metal mixture into a compression mold having a negative image of the threaded fastener form tool;

compressing the mixture in the compression mold to form a green part having at least the near net shape of the threaded fastener form tool;

removing the green part from the mold; and sintering the green part to form a densified part having at least the near net shape of the threaded fastener form tool.

8. The method of claim 7 further comprising the step of heat treating the densified part.

9. The method of claim 8 wherein the heat treating step comprises austempering the densified part.

10. The method of claim 8 wherein the heat treating step comprises induction hardening the densified part.

11. The method of claim 8 wherein the heat treating step comprises case hardening the densified part.

12. The method of claim 8 further comprising the step of finish machining the densified part after the heat treating step.

* * * * *